US010311695B2

(12) United States Patent
Sundholm

(10) Patent No.: US 10,311,695 B2
(45) Date of Patent: Jun. 4, 2019

(54) METHOD AND SYSTEM FOR MONITORING

(71) Applicant: MARICARE OY, Vantaa (FI)

(72) Inventor: Göran Sundholm, Tuusula (FI)

(73) Assignee: MARICARE OY, Vantaa (FI)

( * ) Notice: Subject to any disclaimer, the term of this patent is extended or adjusted under 35 U.S.C. 154(b) by 0 days.

(21) Appl. No.: 15/108,962

(22) PCT Filed: Dec. 23, 2014

(86) PCT No.: PCT/FI2014/051054
§ 371 (c)(1),
(2) Date: Jun. 29, 2016

(87) PCT Pub. No.: WO2015/101708
PCT Pub. Date: Jul. 9, 2015

(65) Prior Publication Data

US 2016/0328941 A1 Nov. 10, 2016

(30) Foreign Application Priority Data

Jan. 3, 2014 (FI) ..... 20145002

(51) Int. Cl.
*G08B 13/16* (2006.01)
*G08B 21/04* (2006.01)
(Continued)

(52) U.S. Cl.
CPC ..... *G08B 21/0438* (2013.01); *G08B 13/1618* (2013.01); *G08B 13/2491* (2013.01);
(Continued)

(58) Field of Classification Search
CPC ..... G08B 21/0438; G08B 13/1618; G08B 13/2491; G08B 21/0469; G08B 25/006; G08B 25/009
(Continued)

(56) References Cited

U.S. PATENT DOCUMENTS 4,550,286 A * 10/1985 Holland ..... B60G 17/0408 280/6.157
4,888,581 A 12/1989 Guscott
(Continued)

FOREIGN PATENT DOCUMENTS

EP 2 472 487 A2 7/2012
EP 2472487 A2 * 7/2012 ..... G08B 21/0423
(Continued)

OTHER PUBLICATIONS

International Search Report (PCT/ISA/210) issued in PCT/FI2014/051054, dated Mar. 4, 2015.
(Continued)

*Primary Examiner* — Steven Lim
*Assistant Examiner* — Mancil Littlejohn, Jr.
(74) *Attorney, Agent, or Firm* — Birch, Stewart, Kolasch & Birch, LLP

(57) ABSTRACT

System and method for observing the presence, location, movement and/or attitude of one or more objects to be monitored with a monitoring system, wherein sensors of the system are disposed in a part, such as on a floor, wall or ceiling, of the area to be monitored, and the system measures with sensors the area to be monitored, and determines the presence, location, movement and/or attitude of the object on the basis of the measurement results of the sensors. The system has a first mode and a second mode, and the system checks in the first mode the attitude and/or state of health of the object in the area to be monitored and functions in the second mode as an intruder alarm monitoring the area to be monitored.

30 Claims, 7 Drawing Sheets

(51) Int. Cl.
*G08B 13/24* (2006.01)
*G08B 25/00* (2006.01)

(52) U.S. Cl.
CPC ..... *G08B 21/0469* (2013.01); *G08B 25/006* (2013.01); *G08B 25/009* (2013.01)

(58) Field of Classification Search
USPC ..... 340/521
See application file for complete search history.

(56) References Cited

U.S. PATENT DOCUMENTS

| | | | | |
|---|---|---|---|---|
| 6,278,401 | B1 | 8/2001 | Wigren | |
| 6,407,556 | B1 | 6/2002 | Rudeke | |
| 6,909,921 | B1 * | 6/2005 | Bilger | G05B 15/02 700/14 |
| 2006/0017558 | A1 | 1/2006 | Albert et al. | |
| 2008/0284592 | A1 | 11/2008 | Collins, Jr. et al. | |
| 2013/0214923 | A1 * | 8/2013 | Sheridan | G08B 21/0423 340/521 |

FOREIGN PATENT DOCUMENTS

| | | | |
|---|---|---|---|
| GB | 2495849 | A | 4/2013 |
| WO | WO 2005/020171 | A1 | 3/2005 |
| WO | WO 2008/008505 | A2 | 1/2008 |
| WO | WO 2009/106685 | A1 | 9/2009 |
| WO | WO 2012/058707 | A1 | 5/2012 |
| WO | WO 2012/115881 | A1 | 8/2012 |
| WO | WO 2012/164169 | A1 | 12/2012 |

OTHER PUBLICATIONS

Written Opinion (PCT/ISA/237) issued in PCT/FI2014/051054, dated Mar. 4, 2015.
Chinese Office Action for Application No. 201480072962.6 dated Jan. 30, 2018.
Supplementary European Search Report for Application No. 14 87 5995 dated Aug. 2, 2017.

* cited by examiner

METHOD AND SYSTEM FOR MONITORING

FIELD OF THE INVENTION

The invention relates to a method and to a system for observing and monitoring an area.

BACKGROUND OF THE INVENTION

The monitoring of the condition of elderly people in a home environment is indispensable if it is desired to lengthen the possibility of an aging population to manage in its home environment. Safety bracelet systems are in widespread use. Their weakness is that the user must wear the bracelet continuously and must be able to press the alarm button in an emergency. Bracelets that check the state of health also exist, but one of their problems is false alarms.

Prior art has also sought solutions in which a film that is of piezoelectric material is installed on the floor, which film registers pressure changes caused by movement on the surface of the floor. Also known to be used are sensors to be installed on the floor, or under it, that detect the presence and movements of people without a change in pressure by means of capacitive sensors.

The possibility of using videocameras, movement detectors that are based e.g. on detecting infrared light, or e.g. ultrasound sensors for monitoring the condition and state of elderly people is also presented in prior art.

The use of a dense near-field sensor field in detecting presence is presented in publication U.S. Pat. No. 6,407,556B1, among others.

The use of pressure sensors for detecting presence or movement is presented in publication U.S. Pat. No. 4,888,581A1, among others.

Known in the art are solutions for tracking a number of objects (multitarget tracking) and e.g. the linking of the type of the object to the object as a part of the tracking of the object is presented in publication U.S. Pat. No. 6,278,401B1.

The use of a near-field sensor that is to be installed in the floor and measuring an electrical connection for making observations is presented in publication W02005020171A1, among others.

Publication WO2009106685 describes a prior-art method and system for tracking objects that uses a dense sensor field.

Publication WO2012164169 describes a prior-art method and system for tracking objects based on ultrasound technology.

A drawback with prior-art observation systems and monitoring systems is that the sensors in the systems can be used for only one functionality, e.g. for monitoring the condition and/or state of elderly people.

BRIEF DESCRIPTION OF THE INVENTION

The invention presents a monitoring system and a monitoring method, which detects objects. The system according to the invention comprises at least one sensor for detecting the presence of an object, said sensor being suited for measuring. In the solution of the invention different types of sensors can be used, which sensors can detect the presence and/or attitude of an object by means of different technologies. In the solution according to the invention the sensors can be installed e.g. on a ceiling, floor or wall. The solution according to the invention can be used e.g. for monitoring the condition and state of elderly people e.g. in their own homes or in retirement homes.

The system according to the invention further comprises measuring electronics that produces sensor observations by means of sensors, and a data processing device, suited to processing sensor observations, that comprises a processor and a memory. The system can detect an object on the basis of the sensor data, monitor the object and/or detect events relating to the object on the basis of one or more sensor observations. The sensor observation can be located e.g. on the basis of the location of the sensor that made the observation. The information collected by the system about the condition and state of elderly people can be sent e.g. to a central control room or to a corresponding body that supervises a certain area and/or people moving in it.

The system according to the invention is adapted to implement, with the sensors used for monitoring the condition and state of elderly people, also monitoring of the area to be monitored against break-ins and/or unknown persons.

By using the method according to claim 1 and the system according to claim 17, the problems of the state of the art can be eliminated and an arrangement can be implemented that corresponds to the requirements according to usage needs. The invention is characterized by what is disclosed in the claims below.

One advantage, among others, in the system according to the invention compared to earlier systems is that the system does not require separate sensors and the use of a parallel intruder alarm system for monitoring the area against break-ins and/or unknown persons, but instead by means of the system according to the invention the existing sensors being used for monitoring the health and/or attitude of people can also be used for implementing intruder alarm functionality.

BRIEF DESCRIPTION OF THE FIGURES

The invention is illustrated with the following drawings, of which

DETAILED DESCRIPTION OF THE INVENTION

In the solution of the invention a number of different types of sensors can be used for monitoring the area to be monitored. Examples of the sensors functioning in the solution of the invention are, inter alia, sensors to be installed on the floor, which can detect the presence of an object e.g. by means of a capacitive field or by means of depression/compression. In the solution of the invention, sensors to be installed e.g. on a wall or ceiling can also be used, which sensors can detect the presence of an object by means of movement, heat or sound waves. The object can be e.g. an elderly person or some other person benefiting from supervision.

Figure 1:
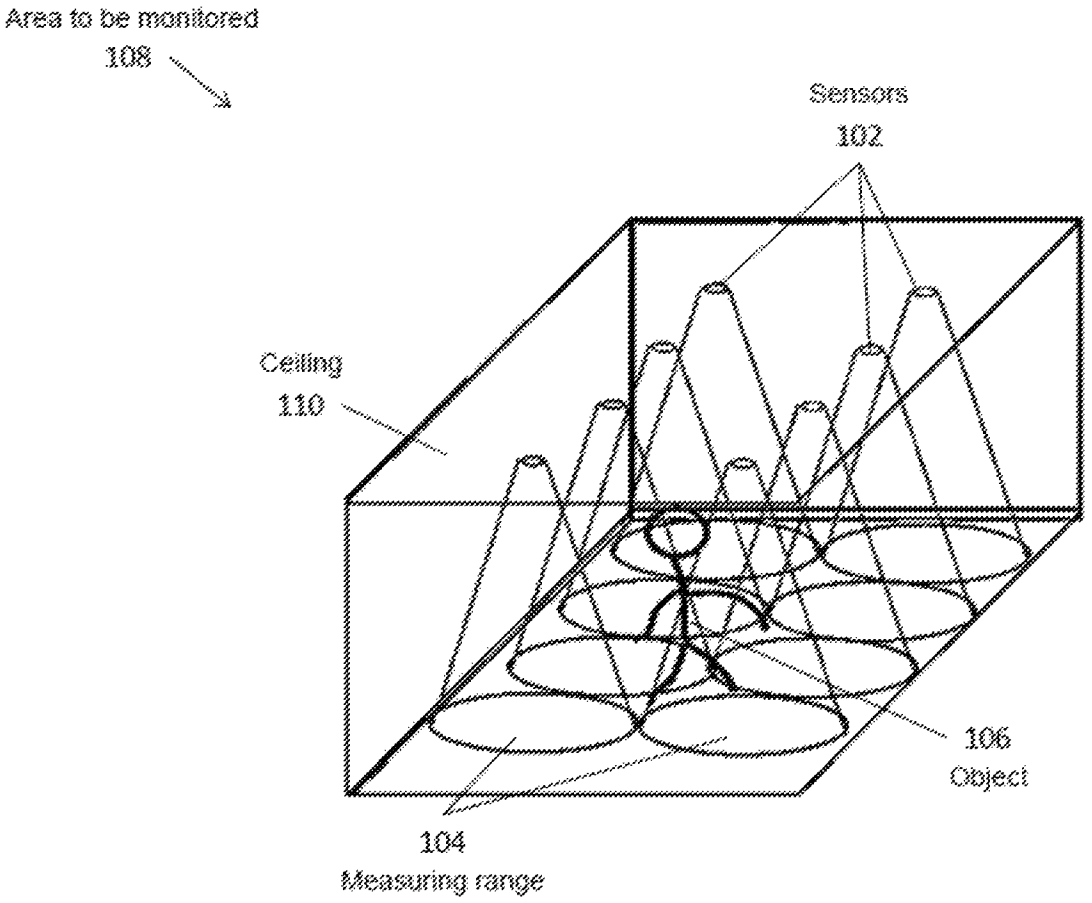
FIG. 1 presents an embodiment of the system according to the invention in an example area in which sensors are installed, in this embodiment a number of ultrasound sensors.

FIG. 1 presents an embodiment of the system according to the invention in an example area in which sensors are installed. In the embodiment of FIG. 1 the sensors 102 are ultrasound sensors. The sensors 102 can be installed e.g. in the ceiling 110 of the area. By means of a number of ultrasound sensors the floor surface of the area 108 to be monitored can be covered with the measuring ranges 104 of ultrasound sensors that are side by side. A measuring range 104 is an area, the ultrasound sensor of which area is able to detect an object 106 in said area. In the case of ultrasound sensors, detection of an object can be performed using the ultrasound sensors 102 for distance measurement, in which case the distance of a sensor to an object 106 that is higher than the level of the floor can be interpreted to mean that an object is in the area being measured by the ultrasound sensor. By means of the precise measurement of distance it can also be deduced whether the object is tall or short and in which attitude it is, e.g. has the object fallen or is it in a lying attitude.

Figure 2:
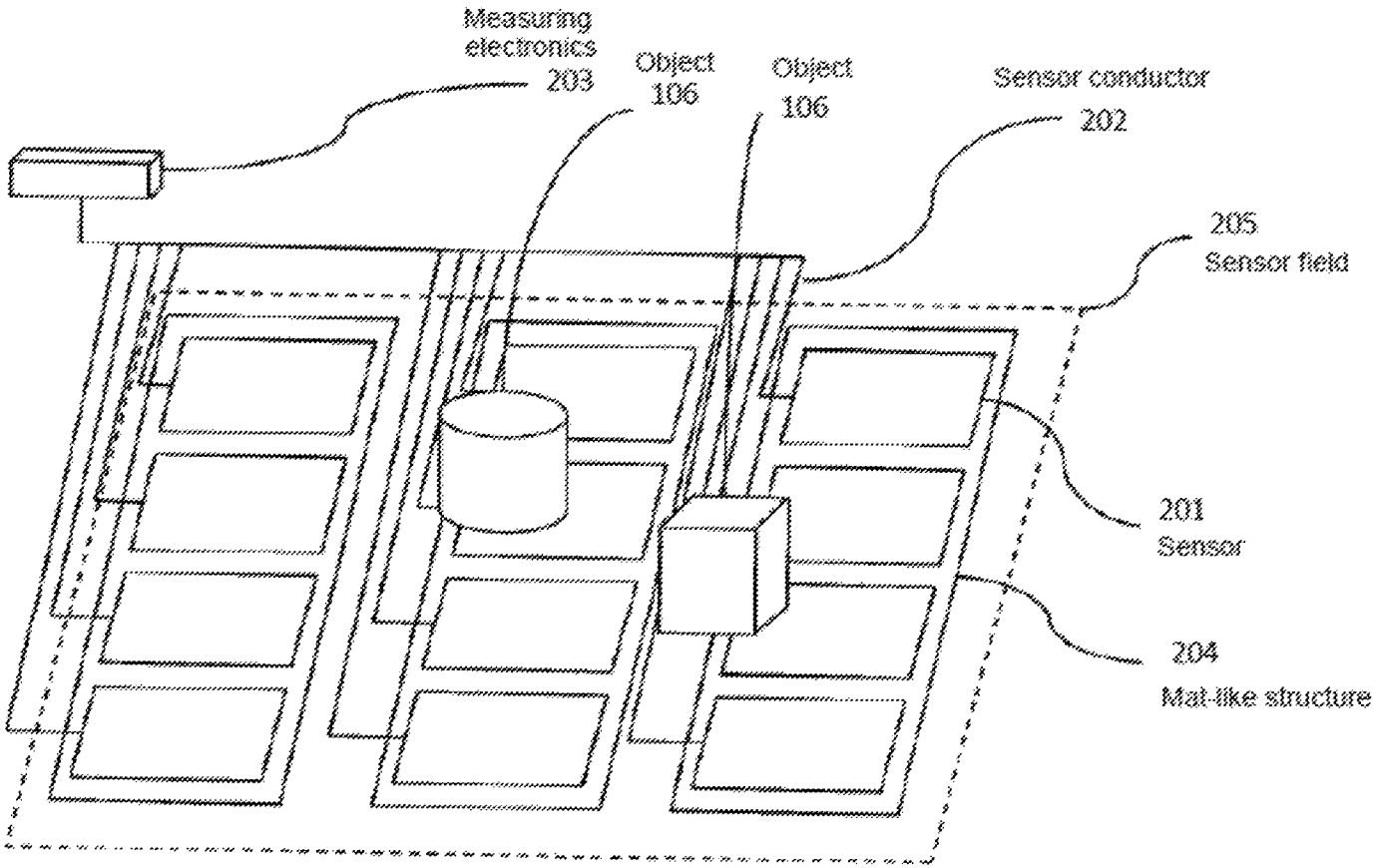
FIG. 2 presents an embodiment of the system according to the invention in an example area in which sensors are installed, in this embodiment a number of planar sensors.

FIG. 2 presents an embodiment of the system according to the invention in an example area in which floor sensors are installed. In the embodiment of FIG. 2 the sensors are sensors 201 used for measuring an electromagnet near field, which sensors form a sensor field 205. The sensors 201 are connected to measuring electronics 203 with sensor conductors 202. The sensors 201 are planar thin sheets or films, which are disposed in a mat-like structure 204 electrically isolated from the environment. The mat-like structure can be disposed under the surface material in the structure of the floor. The surface material of the floor is not shown in the figure. The sensors 201 are used for monitoring the area to be monitored delimited to the sensor field and for detecting objects 106 that are in, or are moving in, the proximity of the sensor field 205. The placement of the sensors 201 in the sensor field 205 is such that the changes in the sensor observations caused by the objects 106 intended to be detected are sufficient for implementing tracking of the objects 106. The sensitivity of the sensors 201 and the distance between the sensors 201 is such that an object 106 intended to be detected and tracked cannot stop in the type of location and attitude in which it does not cause an adequately large change in the sensor observation from the viewpoint of tracking. With the sensor type presented in FIG. 2 it is also possible to detect e.g. whether an object has fallen or is in a lying attitude.

Figure 3A:
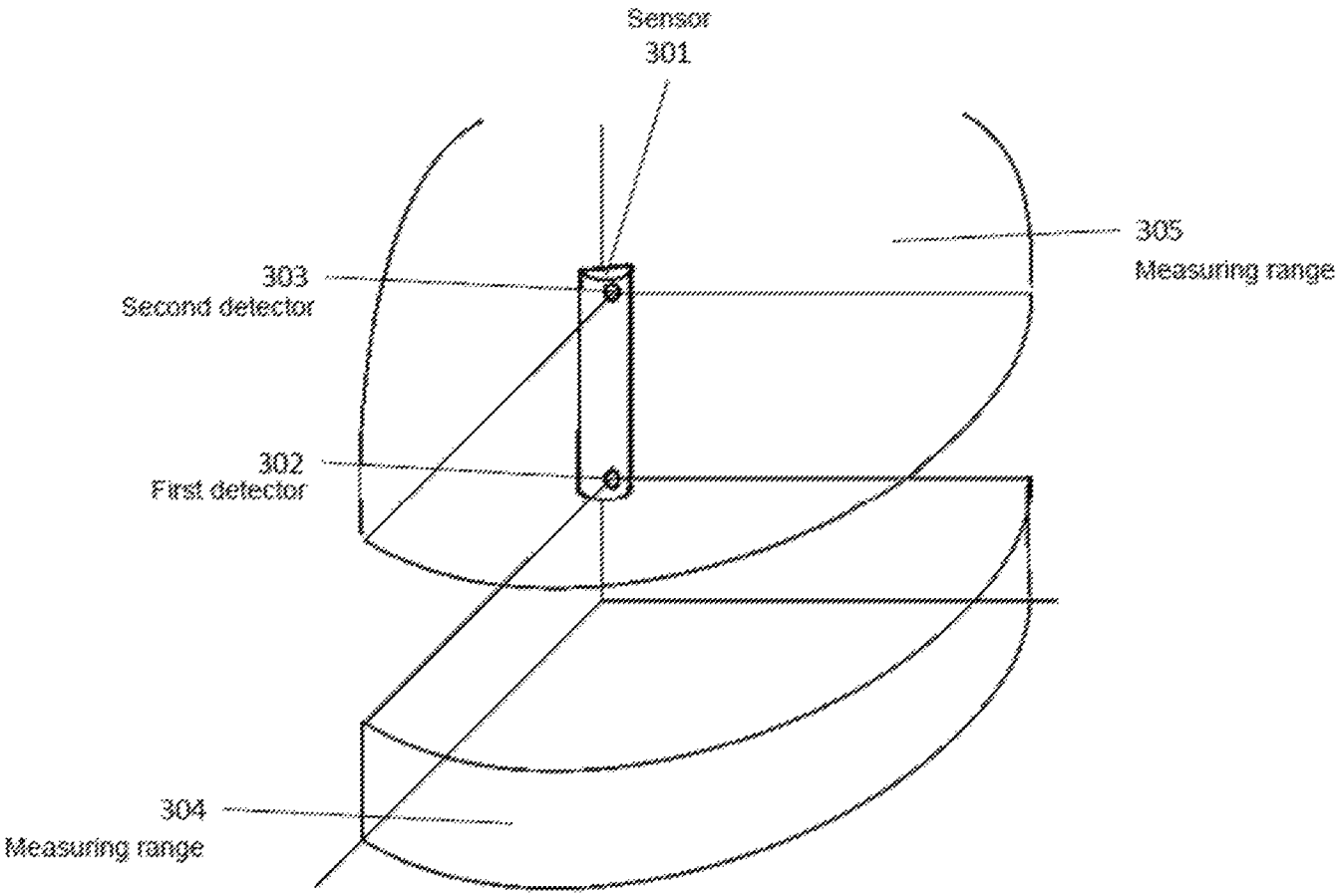
FIGS. 3A-C present a sensor according to an embodiment of the system according to the invention
Figure 3B:
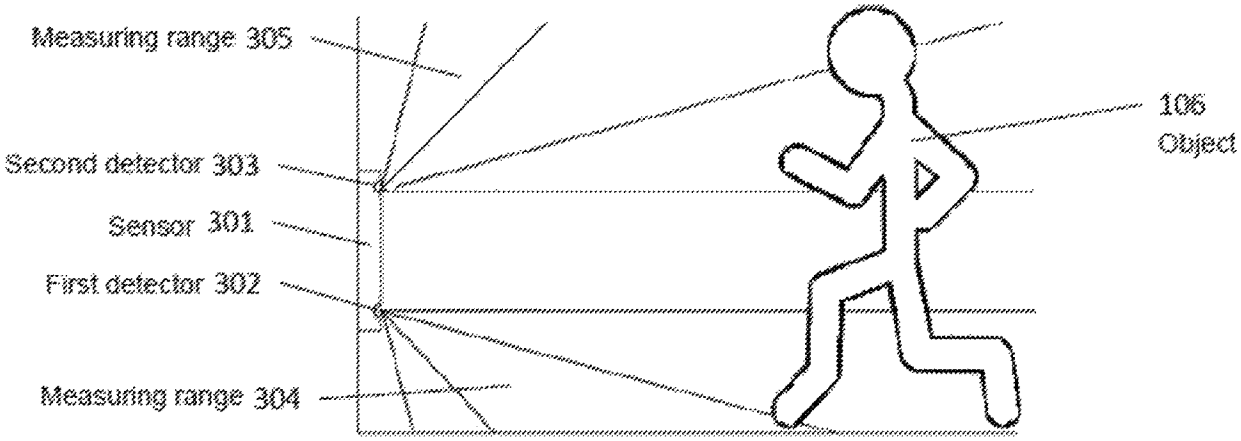
Figure 3C:
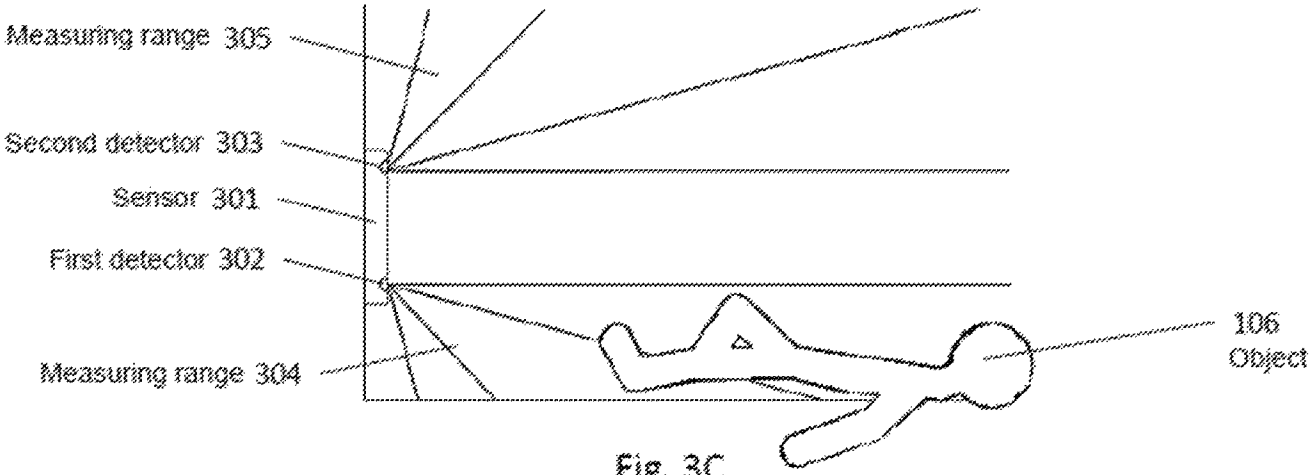

FIGS. 3A-C present a sensor according to an embodiment of the system according to the invention. The sensor 301 according to this embodiment is adapted to measure two sectors that are at different heights. The sensor 301 can be installed e.g., on a wall or in a corner of the area to be monitored, typically above the floor-level plane, e.g. at a height of approx. 40-50 cm from the floor. Corner installation suits the sensor well because its field of vision can be e.g. approx. 100 degrees on the horizontal plane. In one embodiment of the invention the sensor 301 has two motion detectors 302, 303, the field of vision of which is limited on the vertical plane in such a way that the measuring range 304 of the first detector 302 is limited to the bottom part of the area to be monitored and the measuring range 305 of the second detector 303 is limited to the top part of the area to be monitored. FIGS. 3B and 3C present as a cross-section the measuring ranges 304, 305 of the detectors 302, 303. In the solution of the invention it is good to arrange the measuring ranges of the detectors in such a way that the detector 303 monitoring the upper part of the area to be monitored detects a standing or upright moving person but not a person that is lying down or has fallen. In this way the system can distinguish an upright person from a person who has fallen e.g. in such a way that if an object 106 is detected with the upper detector, it is interpreted that the person is upright but if an object 106 is not detected with the upper detector and the object is detected with the lower detector, it can be interpreted that the person has fallen. In one embodiment of the invention between the measuring ranges 304, 305 of the first detector 302 and the second detector 303 remains a vertical area, which does not belong to the measuring range of either detector.

The motion detectors 302, 303 of the sensor 301 can be e.g. passive infrared sensors (PIR), ultrasound sensors, microwave sensors or combination sensors, such as a combination of a passive infrared sensor and a microwave sensor or a combination of two passive infrared sensors. The detectors of the sensor 301 can also be implemented with other technologies, by means of which the sensor is adapted to measure the presence and/or movement of an object in two different measuring ranges 304, 305 in the height direction.

In one embodiment of the invention temperature sensors can be used as sensors of the system, with which the size of the thermal print of an object in the area to be monitored is measured. If the object falls, the thermal print is larger and in this way the system can interpret that the object has fallen. At the same time the body temperature of the object and whether the object is alive can be checked.

The system according to the invention further comprises measuring electronics that produces sensor observations by means of sensors, and a central unit, suited to processing sensor observations and comprising a processor and a memory, which central unit is e.g. a data processing device. The central unit of the system can manage one or more sensors or sensor groups, wherein one sensor group means e.g. the sensors in the same space, such as in a room.

The processor, central unit and/or measuring electronics can be integrated into the sensors or they can be disposed separately or in separate units. In the embodiment described in FIG. 3 the program executed by the processor interprets the movements observed in the top and bottom parts of the area being monitored and gives an alarm if the alarm conditions defined for the program are fulfilled.

A sensor measuring two different height ranges can indicate falling e.g. according to the following alarm conditions:

1. If movement is detected in the top part of the area to be monitored, go to item 2.
2. If movement is detected only in the bottom part of the area to be monitored, go to item 3.
3. Wait for 10 seconds. If movement is detected in the top part of the area to be monitored, go to item 1.
4. Give a fall alarm and go to item 1.

A sensor measuring two different height ranges can indicate an intrusion e.g. in such a way that if it detects movement in any measuring range of the sensor whatsoever, an alarm is given.

If there are pets in the area to be monitored, the sensor measuring two different height ranges can be adjusted to function in such a way that it activates for measuring only if the upper detector detects an object. When an object arrives in the area to be monitored, the upper detector detects the object on the basis of how tall it is and the monitoring is continued. If a smaller creature, such as a dog, goes inside into the room, the sensor does not activate for measuring because the upper detector does not receive excitation. In this type of situation the sensor can detect a break-in e.g. according to the following alarm conditions:

1. If movement is detected only in the top part of the area to be monitored, go to item 2.
2. Give an intruder alarm and go to item 1.

In the system there can also be a control center and the predetermined information concerning the presence, location, movement and/or attitude of the object can be sent to the control center. The alarm terms used by the system can be changed, e.g. on the basis of presence information received from an RFID reader. An alarm can be given e.g. to an external alarm system or wirelessly to a central server of the system, from which server the alarm is directed onwards.

The system can also have a memory means, in which the system is adapted to record a measurement signal, or information deduced from it, for observing the chronological dependency of the area to be monitored and the behavior of objects. By means of this the system can give an alarm e.g. if a person being monitored has not got out of bed or visited the kitchen for a certain time, or if the person has gone to the toilet too often. The memory means also enables learning of a more common daily rhythm and the detection of aberrations occurring in it.

In one preferred embodiment of the invention the system detects falling, and the extent of the observations that express the proximity of some body part by their strength that are linked to an object are used as an event condition of the falling event, expressed as the area covered by the observations and as the largest distance between the observations, as a change in the speed of the extent, and as the subsequent permanence of the location and strength. Observations, which change at a determined speed from observations corresponding to a vertical attitude to observations corresponding to a fallen person, are interpreted according to the condition as falling.

An area to be monitored with sensors can be the whole area or only a part of some area. The area to be monitored can be composed e.g. of one or more rooms and certain parts of the area, e.g. fixed installations such as cupboards, can be left outside the area to be monitored.

The system according to the invention can also combine the information of a number of sensors and deduce by means of the information of a number of sensors e.g. the movement and attitude of an object. In the solution of the invention also information measured with different types of sensors can be combined, and the control and management of the system can be implemented by the action of control devices and softwares that are common to the different sensor types.

In many applications it is advantageous to first perform a charting of the unchanged area, i.e. to chart the measuring information of the sensors when mainly unmoving and unchanging objects and structures are in place. This type of situation is e.g. in a residential apartment when the furniture is in position but there are no people, pets or robots in the apartment. This charted information can be recorded in the system, e.g. in a memory that is located in the central unit or in a memory means that is in connection via a data network, which memory means can be e.g. in a control center or service center. For this purpose memory means must be comprised in the arrangement, which memory means can be in the central unit or connected to it via a data network.

According to one embodiment of the invention the system performs a charting of the unchanged area continuously or at defined intervals, in which case the system is able to detect e.g. changes in the area caused by new furniture or by changes in the location of furniture. In this way the system is able to adapt gradually to changes occurring in the area to be monitored.

By means of the sensors of the system the movements of an object can be checked. For the purposes of this function the central unit of the system comprises the necessary software and information about the characteristic properties of the signals being detected. Generally the central unit can deduce information from a signal received via a sensor, e.g. about the location, speed, movement direction, state or attitude of an object.

Generally, at least some of the sensors of the system are disposed in the proximity of those types of surfaces, or on the surfaces, such as e.g. floor surfaces, wall surfaces, door surfaces or ceiling surfaces of an apartment, of the area to be monitored to which, or into the proximity of which, the object has access.

Figure 4:
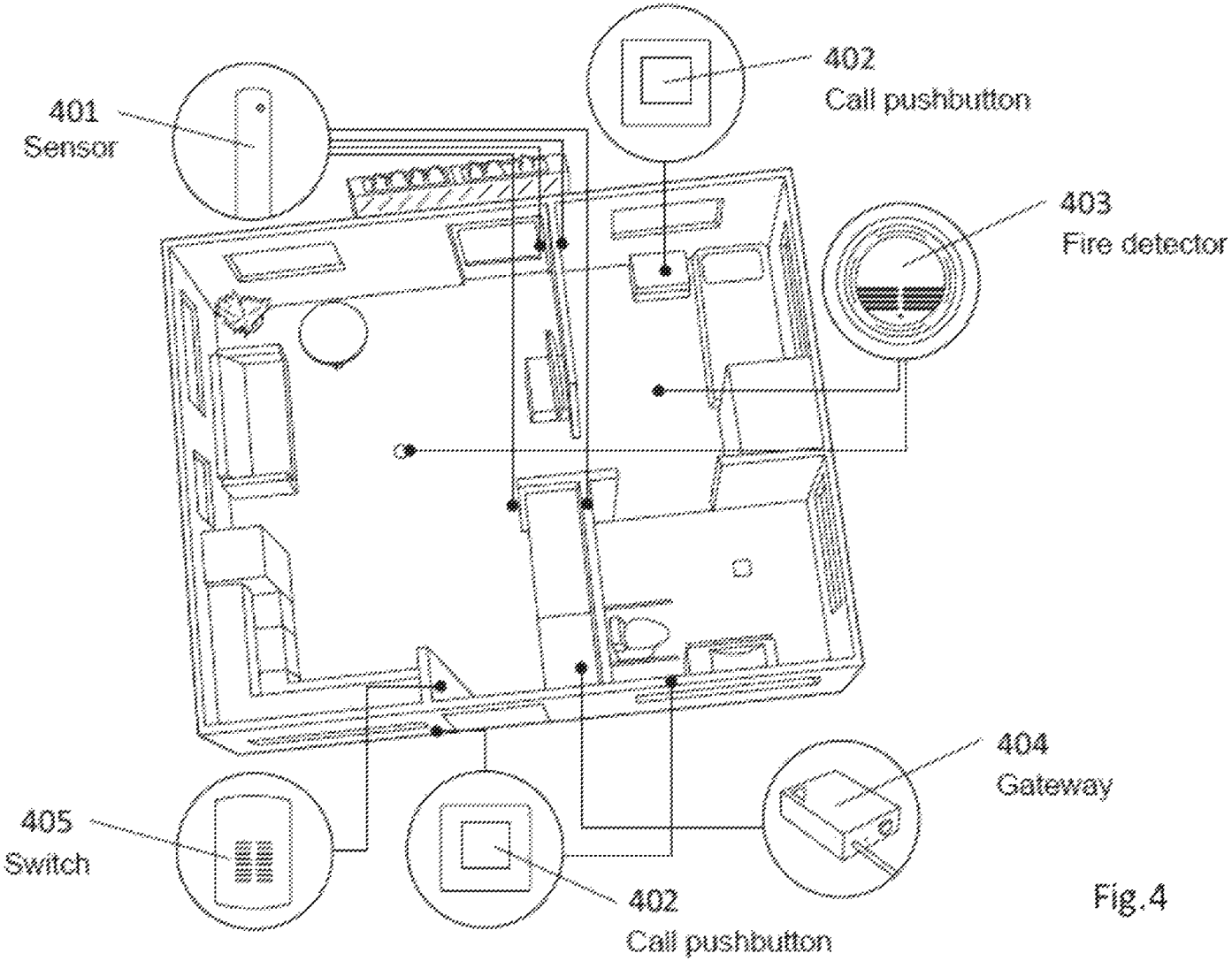
FIG. 4 presents the components of an embodiment of the system according to the invention in the area to be monitored.

FIG. 4 presents the components of an embodiment of the system according to the invention in the area to be monitored. The sensor 401 or sensors to be used in the invention are disposed in connection with the area to be monitored in such a way that by means of the sensor 401 or sensors the area to be monitored can be monitored. A sensor can be e.g. a fall detector or intrusion detector and it can be disposed in any apartment whatsoever. If sensors to be installed on top of a surface, e.g. a wall, floor or ceiling surface, are used they can be fastened to the surface e.g. with double-side tape or with a sticker strip, in which case they can easily be removed. The sensors 401 can be connected wirelessly or by wireline to the gateway 404, which collects measured values obtained from the sensors 401 or status information formed by the sensors 401, e.g. about the objects detected, the state of health of the objects and/or the attitudes of the objects. The gateway 404 sends the information onwards e.g. to a control center or to another body that supervises the area and/or the objects therein. The transfer of information between the system and some recipient can be performed e.g. using a phone connection, a wireline broadband connection or wireless connections. It is advantageous in the data transfer to take into account issues relating to data security and privacy, which many official regulations also address. The gateway 404 can be freely situated and is immediately ready for use.

In one embodiment of the invention the sensor 401 or sensors comprise an own central unit and the central unit of a sensor is in connection with the gateway 404. In a second embodiment of the invention the central units of the sensor 401 or sensors are integrated into a gateway 404.

It is possible that some of the functions of the central unit or of the gateway 404 are performed elsewhere via a data network connection, e.g. in a central control room or service center.

The system according to the invention can also comprise a call pushbutton 402, after the pressing of which the system can form a connection e.g. to nursing personnel, security personnel or it can perform various alarm procedures. The call pushbutton can be wireless and it can be adapted to function without batteries.

The alarm procedures according to the system of the invention can include e.g. the starting of alarm indication signaling (buzzer, light, siren, alarm clock), making contact with an alarm center or service center, a care provider or a relative. In some cases, an alarm can also be given directly to the person being monitored or to the user, e.g. by means of speech synthesis or a speech recording. For example, an elderly person trying to go to the outer door during the night can be guided back to sleep. For performing these tasks the arrangement can comprise means needed for processing time data, such as e.g. a clock circuit.

The system according to the invention can also comprise a switch 405, by means of which a user can change the mode of the system from monitoring the attitude and state of health of the object to intruder alarm mode operation. The switch 405 can be e.g. a lever switch or some other mechanical switch, such as a pushbutton, a numerical pushbutton, a numerical keyboard or a reading device, e.g. an RFID reader, operating wirelessly. By means of the switch 405 an alarm procedure that is in progress or performed can be reset, ended or cancelled. The switch 405 can also comprise an alarm siren or the alarm siren of the system can be disposed elsewhere.

The system can also comprise a light alarm and sound alarm unit, which indicates, with a light signal and/or a sound signal, e.g. the ringing of the doorbell or an incoming phone call.

The system according to the invention can also comprise fire detectors 403, which can be in connection with another system via a wireline or wireless connection. If the fire detectors 403 warn of a fire, alarm procedures can be performed, e.g. by sending an alarm message to a control center or to the rescue authorities.

Figure 5:
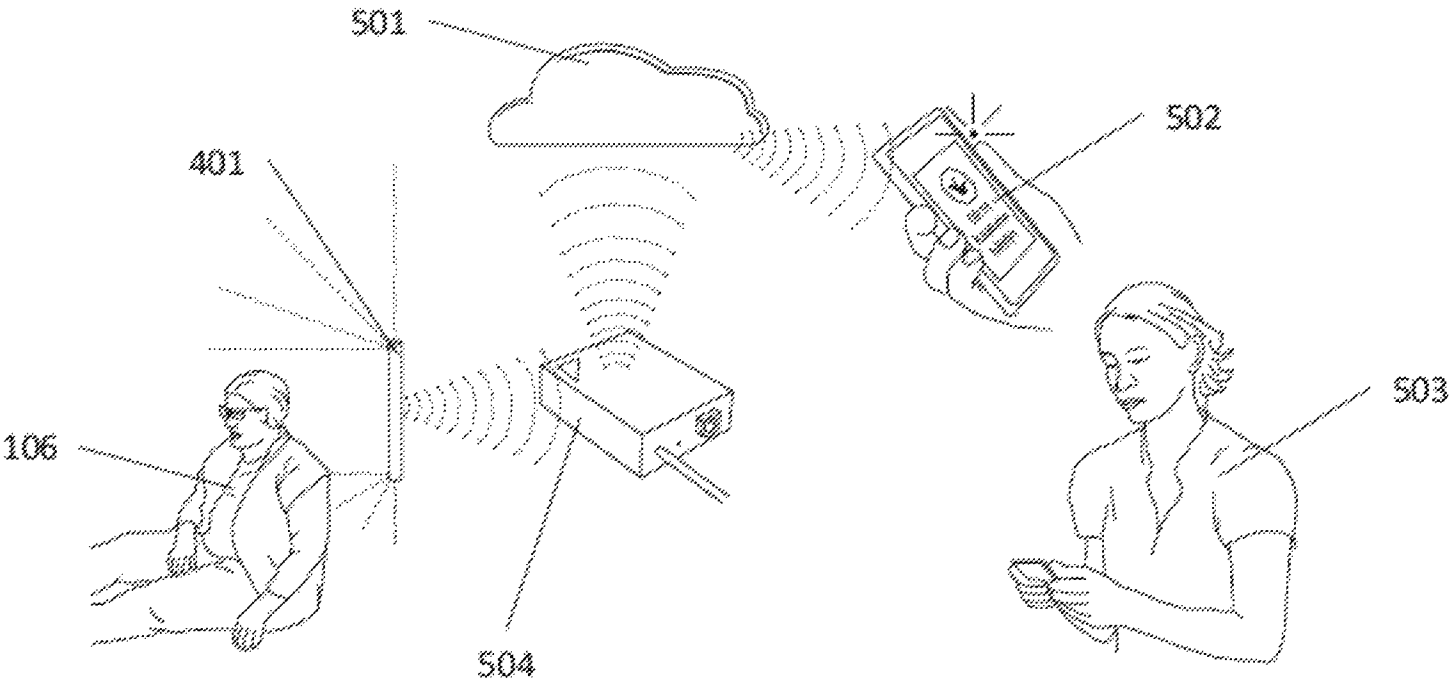
FIG. 5 presents the operation of an embodiment of the system according to the invention in the first mode of the system.

FIG. 5 presents the operation of an embodiment of the system according to the invention in a first mode of the system, i.e. in the mode in which the state of health or attitude of a person 106 in the area to be monitored is monitored. When the sensors 401 of the system detect that an object 106 in the area to be monitored has fallen or that a change has occurred in his/her state of health, the system sends this information via the system gateway 504 onwards and at the same time the system can perform predetermined alarm procedures. In the embodiment presented in FIG. 5 the sensor 401 sends information about the attitude or falling of the object, e.g. a fall alarm, to the gateway 504 of the system and the gateway 504 sends the information and/or an alarm onwards to the server 501 e.g. via an Internet connection or other connection. From the server 501 the information and/or alarm is sent to a body monitoring the health of the person e.g. as a message to a phone 502, as an alarm and/or e.g. to a nurse 503, to relatives or to an emergency center. In this way e.g. information about the falling of the person reaches the necessary people or organizations and the person who fell receives help as quickly as possible. In one embodiment of the invention the system can send information directly from the gateway 504 to a body monitoring the health of the person.

Figure 6:
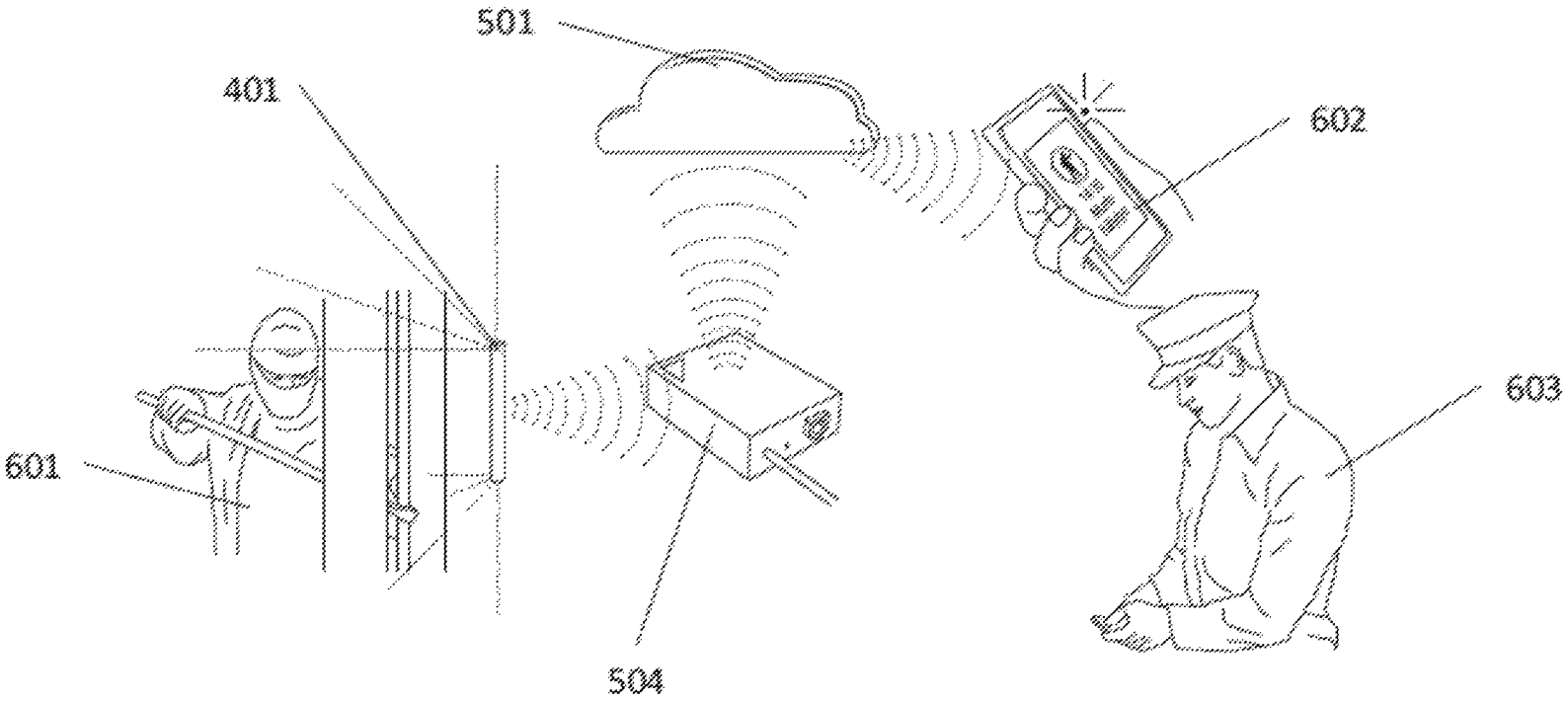
FIG. 6 presents the operation of an embodiment of the system according to the invention in the second mode of the system.

FIG. 6 presents the operation of an embodiment of the system according to the invention in a second mode of the system, i.e. in the intruder alarm mode. When the sensors 401 of the system detect that an object 601, e.g. an unknown person, has arrived in the area to be monitored, the system sends this information via the system gateway 504 onwards and at the same time the system can perform predetermined alarm procedures. In the embodiment presented in FIG. 6 the sensor 401 sends information about the presence of an object 601 to the gateway 504 of the system and the gateway 504 sends the information and/or an alarm, e.g. an intruder alarm, onwards to the server 501, e.g. via an Internet connection or other connection. From the server 501 the information and/or alarm is sent to a body monitoring safety, e.g. as a message to a phone 602, as an alarm and/or e.g. to a security company, to a guard 603, to an emergency center or to the police. In this way e.g. information about a break-in or an intrusion by an unknown person into the area to be monitored reaches the necessary people or organizations. In one embodiment of the invention the system can send information directly from the gateway 504 to a body monitoring safety.

In the system according to the invention a user uses the first mode of the system e.g. when he/she is at home and in this case his/her state of health and/or attitude can be checked by means of the system. When the user leaves his/her home or goes to sleep, he/she can set the system into the second mode, i.e. the intruder alarm mode, in which case the system functions as an intruder alarm system, giving an alarm when it detects an object in the area to be monitored. A user can change the mode from a switch, by means of a numerical code or by means of an RFID reader. When the user comes back home or gets out of his/her bed, he/she can set the system from the second mode, i.e. the intruder alarm mode, into the first mode, i.e. the state-of-health monitoring mode. It is also possible to switch the system off. Since also outsiders can change the mode of the system by means of a simple switch, such as a pushbutton, the keying in of a numerical code on a numerical keyboard or an RFID reader offer better security against outsiders in the intruder alarm mode.

Also when bodies who have received an alarm or people otherwise authorized to go into the area to be monitored, e.g. a nurse or guard, go into the apartment, they can switch the system from the second mode into the first mode, or off, because otherwise their arrival at the scene would trigger an alarm. Also the aforementioned bodies can change the mode in the same way as the object in the area whose state of health is being checked. Bodies who have received an alarm or people otherwise authorized to go into the area to be monitored can have e.g. their own numerical codes or RFID identifiers, by means of which the system can be switched from the second mode into the first mode, or off completely. In one embodiment of the invention the mode of the system can also be changed by means of remote control, e.g. from a control center.

In one embodiment of the invention the system mode can change automatically from the first mode into the second mode and from the second mode into the first mode. In one embodiment of the invention the system can detect that a person has exited the area to be monitored and change the mode automatically from the first mode into the second mode, i.e. from monitoring the state of health/attitude into the intruder alarm mode. When the system detects that an object, whose state of health is being checked, arrives back into the area to be monitored, it can automatically switch the mode of the system from the second mode into the first mode, i.e. from the intruder alarm mode into the state-of-health monitoring mode. In one embodiment of the invention the operating mode of the system can be automatically changed from the monitoring of state of health/attitude to the intruder alarm mode when the object whose state of health is being checked gets into his/her bed. The operating mode can also be automatically changed from the intruder alarm mode to the monitoring of state of health/attitude when the person gets out of his/her bed.

The automatic change in mode can function also between different parts of the area to be monitored. In this case if a person has gone into one part of the area to be monitored, e.g. to a second floor, into a second room, into the bedroom or into bed, then the other parts of the area to be monitored, e.g. the other floor, the other rooms or the living room, can be automatically switched into the second mode, i.e. into the intruder alarm mode. When the person comes out of the same area, e.g. after waking up, the mode is changed automatically into the first mode, i.e. to monitoring the state of health/attitude, and the intruder alarm mode automatically switches off in the relevant part of the space to be monitored. In one embodiment of the invention if the person whose state of health is being monitored has gone to bed, the system does not form a signal for exiting a room. With the system according to the invention safety can therefore be monitored automatically, e.g. as follows: A resident of an apartment goes to sleep in the evening in his/her bed. If after this somebody arrives in the apartment, the system performs alarm procedures. When the resident awakes and gets out of his/her bed, the intruder alarm mode is switched out of use.

In one embodiment of the invention the intruder alarm mode can be automatically switched on or off by means of a sensor arranged in one part of the space to be monitored, e.g. in one room, such as e.g. by means of the type of sensor presented in FIG. 2 or 3. In this case by means of the information measured by the sensor arranged in one part of the space, the intruder alarm mode of the rest of the area to be monitored or of the whole area to be monitored can be switched on or off. This can be done e.g. in such a way that when it is detected on the basis of a sensor installed in one room that a person has gone to sleep, the intruder alarm mode is changed to the active state in the whole of the area to be monitored or in a part of the area to be monitored. When it is detected on the basis of the same sensor arranged in one part of the space that the person has woken up and got out of bed, the intruder alarm mode can be switched off in the whole of the area to be monitored or in a part of the area to be monitored. A person getting out of bed can be detected with a planar sensor to be installed on the floor from when a foot of the person is detected in connection with the sensor and/or, with the sensor of FIG. 3, from the detector limited to the bottom part of the area to be monitored detecting a movement. A person getting into bed can be detected from an object that was detected earlier in connection with or in the proximity of the bed disappearing from the measuring range of the planar sensor or from the measuring range of the detector limited to the bottom part of the area to be monitored.

In one embodiment of the invention sensors for a different purpose of use can be used in the different parts of the area to be monitored: one or more sensors can function as a sensor for intruder alarm monitoring and one or more sensors as a sensor detecting the presence of a person or detecting other information relating to the person, by means of the information measured by which sensor the intruder alarm mode, and simultaneously the sensors for intruder alarm monitoring, can be activated for intruder alarm monitoring. In one embodiment of the invention, the sensors could be adapted to function in only one mode or the other, e.g. as an intruder alarm sensor or as a sensor that is used to activate the intruder alarm mode. The sensors that are for a different purpose of use can be sensors that are different types to each other or, alternatively, sensors of the same type. In one embodiment of the invention in one part of the space e.g. sensors of the type presented in FIG. 3, such as ultrasound sensors, can be used and in another space sensors to be installed in connection with the floor, e.g. of the type presented in FIG. 2, or other planar sensors can be used. In one embodiment of the invention the one type of system sensors, such as e.g. ultrasound sensors, could be arranged to function only as intruder alarm sensors in a part of the space to be monitored or in all the space to be monitored, and the other type of sensor, such as e.g. a planar sensor or ultrasound sensor, to function as a means that can automatically switch the intruder alarm mode into use or out of use. In this case the system can function e.g. as follows: by means of one sensor or sensor arrangement, which is fitted in one room or in a part of a room, such as in the proximity of a bed, it is detected whether a person is going to sleep. In this case the intruder alarm mode is switched on and the sensors to be used as an intruder alarm are activated. When the person gets out of his/her bed, this is detected with the sensor and in this case the intruder alarm mode is switched off. In this type of system it is sufficient, therefore, that a sensor detecting the condition, state or presence of a person is installed in only one part of the space, such as e.g. in one room or in one part of a room, e.g. in connection with a bed.

In one embodiment of the invention the system can operate as an intruder alarm also in the first mode of the system. In this case the system checks the state of health and/or attitude of the object in the area to be monitored and tracks the location of the object, but if another object, e.g. a person who is an outsider, arrives in the area to be monitored from another direction, an intruder alarm can be executed. By means of the sensors it is possible also to detect if a number of people are in the area to be monitored without authorization and also in this case an alarm procedure can be performed. This is the type of situation is e.g. a person who is an outsider has come in from the outer door without an identifier and the resident is in the room.

The system can also control the functions of the area to be monitored, such as the lighting, air-conditioning, access control, locking, and other alarms systems, control systems and/or monitoring systems. In one embodiment of the invention the system controls the operation of the water supply, electricity supply and/or heat supply in the area to be monitored when an object whose state of health and/or attitude is being checked leaves the area to be monitored or leaves a part, e.g. a room, of the area to be monitored. For example, the lights can be extinguished and the water and electricity disconnected from an area, or from a part of an area, from which the object has exited. In one embodiment of the invention when a person gets out of bed to go to the WC, the lights turn on in such a way that the person sees to walk to the WC. When the object goes into the WC, the light of the WC can be turned on. In one embodiment of the invention also the current of the cooker can be disconnected if the object goes away from in front of the cooker for a certain time, e.g. over 20 minutes. In one embodiment of the invention the water supply can be disconnected e.g. by means of a solenoid valve and e.g. in the WC/bathroom premises when the object is not in these premises. There can be a delay in the disconnection of water, so that e.g. the flushing tank of the toilet fills after use. A corresponding arrangement can also be in the kitchen, in which the water is switched off if the object leaves the kitchen.

In one embodiment of the invention when the object leaves the apartment and the system is set into the second mode, i.e. the intruder alarm mode, the water and electrical devices can be closed automatically. Also the temperature can be adjusted on the basis of the presence of the object e.g. in such a way that the temperature in winter is decreased e.g. to 2 degrees lower and in the summer the cooling is reduced and the temperature is raised e.g. 2 degrees higher when the object is not in the area to be monitored or in a part of the area to be monitored.

It is obvious to the person skilled in the art that the different embodiments of the invention are not limited solely to the examples described above, and that they may therefore be varied within the scope of the claims presented below. The characteristic features possibly presented in the description in conjunction with other characteristic features can also, if necessary, be used separately to each other.

The invention claimed is:

1. A method for observing the presence, location and/or movement of one or more objects to be monitored with a monitoring system, wherein at least one sensor of the system is disposed on at least one of a floor, wall and/or ceiling, of the area to be monitored and the system measures with a sensor or with sensors the area to be monitored, and determines the presence, location and/or movement of the object on the basis of the measurement results of the sensor or sensors comprising the following steps:

operating the system in a first mode and a second mode, checking in the first mode the state of health of the object in the area to be monitored, operating the system in the second mode as an intruder alarm monitoring the area to be monitored, and using the same sensor in both the first mode for checking the state of health of the object in the area to be monitored and also in the second mode as an intruder alarm for monitoring the area to be monitored, wherein the system changes the mode automatically, including:

changing the mode of the area to be monitored to the first mode if the one or more objects to be monitored are located in the area to be monitored, and changing the mode of the area to be monitored to the second mode if the one or more objects to be monitored are located outside the area to be monitored, and wherein the first mode also includes the intruder alarm monitoring the area to be monitored by tracking the location of the object and determining if an unauthorized object enters the area to be monitored.

2. The method according to claim 1, wherein when it is operating in the first mode the system performs a health alarm procedure when it detects with sensors the change in the state of health of an object.

3. The method according to claim 2, wherein the health alarm procedure is an alarm or the sending of a message to a body monitoring the health of the object, a message to a phone, as an alarm and/or to a nurse, to relatives or to an emergency center.

4. The method according to claim 2, wherein an alarm is given to the object being monitored by means of speech synthesis or a speech recording.

5. The method according to claim 1, wherein when it is operating in the second mode the system performs intruder alarm procedures when it detects with sensors an object in the area to be monitored.

6. The method according to claim 1, wherein the intruder alarm procedure is an alarm or the sending of a message to a body monitoring the safety of the area to be monitored, a message to a phone, as an alarm and/or to a security company, to a guard, to an emergency center or to the police.

7. The method according to claim 1, wherein the system comprises a switch, by means of which a user can change the mode of the system.

8. The method according to claim 7, wherein the switch is a mechanical switch, a lever switch or pushbutton, a numerical pushbutton, a numerical keyboard or a reading device, an MD reader, operating wirelessly.

9. The method according to claim 1, wherein the system automatically switches from the second mode into the first mode when an object whose state of health is being checked arrives in the area to be monitored.

10. The method according to claim 1, wherein the system indicates in the second mode that an outsider has come into the space.

11. The method according to claim 1, wherein the system controls the operation of the water supply, electricity supply and/or heat supply in the area to be monitored when an object whose state of health is being checked leaves the area to be monitored or leaves a part of the area to be monitored.

12. The method according to claim 1, wherein the measuring ranges of the sensors essentially cover the area to be monitored.

13. The method according to claim 1, wherein the system sends information derived from the object onwards using a wireline or wireless telecommunications connection.

14. A system for observing the presence, location and/or movement of one or more objects to be monitored in the area to be monitored, which system comprises at least one sensor, wherein a sensor or sensors are fitted into at least one of a floor, wall and/or ceiling, of the area to be monitored and wherein the sensor or sensors produce measuring information, by means of which measuring information the system is adapted to determine the presence, location and/or movement of an object, wherein:

the system has a first mode and a second mode, the system is adapted to check in the first mode the state of health of the object in the area to be monitored, the system is adapted to function in the second mode as an intruder alarm monitoring the area to be monitored, wherein the system is adapted to use the same sensor in both the first mode for checking the state of health of the object in the area to be monitored and also in the second mode as an intruder alarm for monitoring the area to be monitored, and wherein the system is adapted to change the mode automatically, including:

changing the mode of the area to be monitored to the first mode if the one or more objects to be monitored are located in the area to be monitored, and changing the mode of the area to be monitored to the second mode if the one or more objects to be monitored are located outside the area to be monitored, and wherein the first mode also includes the intruder alarm monitoring the area to be monitored by tracking the location of the object and determining if an unauthorized object enters the area to be monitored.

15. The system according to claim 14, wherein when it is operating in the first mode the system is adapted to perform a health alarm procedure when it detects the changing of the state of health of the object.

16. The system according to claim 15, wherein the health alarm procedure is an alarm or the sending of a message to a body monitoring the health of the object, a message to a phone, as an alarm and/or to a nurse, to relatives or to an emergency center.

17. The system according to claim 15, wherein the system is adapted to give an alarm to the object being monitored, by means of speech synthesis or a speech recording.

18. The system according to claim 14, wherein when it is operating in the second mode the system is adapted to perform intruder alarm procedures when it detects with sensors an object in the area to be monitored.

19. The system according to claim 14, wherein the intruder alarm procedure is an alarm or the sending of a message to a body monitoring the safety of the area to be monitored, a message to a phone, as an alarm and/or to a security company, to a guard, to an emergency center or to the police.

20. The system according to claim 14, wherein the system comprises a switch, by means of which a user can change the mode of the system.

21. The system according to claim 20, wherein the switch is a mechanical switch, a lever switch or pushbutton, a numerical pushbutton, a numerical keyboard or a reading device, an RFID reader, operating wirelessly.

22. The system according to claim 14, wherein the system is adapted to automatically switch from the second mode into the first mode when an object whose state of health is being checked arrives in the area to be monitored.

23. The system according to claim 14, wherein the system is adapted to indicate in the second mode that an outsider has come into the space.

24. The system according to claim 14, wherein the system is adapted to control the operation of the water supply, electricity supply and/or heat supply in the area to be monitored when an object whose state of health is being checked leaves the area to be monitored or leaves a part of the area to be monitored.

25. The system according to claim 14, wherein the measuring ranges of the sensors essentially cover the area to be monitored.

26. The system according to claim 14, wherein the system is adapted to send information derived from the object onwards using a wireline or wireless telecommunications connection.

27. The system according to claim 14, wherein the sensor is a sensor detecting movement, a capacitive sensor, an ultrasound sensor and/or a temperature sensor.

28. The system according to claim 14, wherein the sensor is a sensor detecting movement and/or presence, which sensor is adapted to measure two measuring ranges that are at a different height.

29. The method according to claim 1, wherein the sensors measure two different height ranges, and indicate a falling if:

a. movement is first detected in a top part of the area to be monitored; then
b. movement is detected only in a bottom part of the area to be monitored; and
c. if after 10 seconds, movement is detected in the top part of the area, return to step a. or
d. if after 10 seconds, movement is not detected in the top part of the area, activate a fall alarm.

30. The system according to claim 14, wherein the sensors are configured measure two different height ranges, and indicate a falling if:

a. movement is first detected in a top part of the area to be monitored; then
b. movement is detected only in a bottom part of the area to be monitored; and
c. if after 10 seconds, movement is detected in the top part of the area, return to step a. or
d. if after 10 seconds, movement is not detected in the top part of the area, activate a fall alarm.

* * * * *